US005186315A

United States Patent [19]

Koppe et al.

[11] Patent Number: 5,186,315

[45] Date of Patent: Feb. 16, 1993

[54] HIGH VOLTAGE DISCONNECTING SWITCH

[75] Inventors: Denis Koppe; Patrick Leruyet, both of St. Genis Laval, France; Francois Duval, Bergamo, Italy

[73] Assignee: Merlin Gerin, France

[21] Appl. No.: 726,923

[22] Filed: Jul. 8, 1991

[30] Foreign Application Priority Data

Jul. 19, 1990 [FR] France ..... 90 09360

[51] Int. Cl.[5] ..... H01H 31/00

[52] U.S. Cl. ..... 200/48 V; 200/49

[58] Field of Search ..... 200/48 R, 48 P, 48 A, 200/48 KB, 49, 288, 145, 146 R

[56] References Cited

U.S. PATENT DOCUMENTS

| | | | |
|---|---|---|---|
| 1,749,537 | 3/1930 | Johnson | 200/48 R |
| 2,750,460 | 6/1956 | Kast | 200/48 A |
| 2,788,403 | 4/1957 | Harault | 200/48 V X |
| 2,796,477 | 6/1957 | Thommer et al. | 200/48 V X |
| 3,885,115 | 5/1975 | Schrotter | 200/245 |
| 4,028,513 | 6/1977 | Laubach | 200/263 X |
| 4,103,122 | 7/1978 | Albright et al. | 200/48 A X |
| 4,243,854 | 1/1981 | Pahl | 200/48 R |
| 4,481,387 | 11/1984 | Worrix | 200/48 R |
| 4,495,390 | 1/1985 | Leppers et al. | 200/48 V X |

FOREIGN PATENT DOCUMENTS

| | | | |
|---|---|---|---|
| 699521 | 12/1964 | Canada | 200/48 A |
| 699860 | 12/1964 | Canada | 200/48 A |
| 0070248 | 1/1983 | European Pat. Off. . | |
| 955616 | 1/1957 | Fed. Rep. of Germany . | |
| 3307606 | 10/1984 | Fed. Rep. of Germany . | |
| 1100132 | 9/1955 | France . | |
| 1204754 | 1/1960 | France . | |
| 1346795 | 11/1963 | France | 200/48 V |
| 1350273 | 12/1963 | France | 200/48 V |
| 840103 | 7/1960 | United Kingdom | 200/48 VR |
| 1154477 | 6/1969 | United Kingdom | 200/48 R |

*Primary Examiner*—Henry J. Recla
*Assistant Examiner*—Glenn T. Barrett
*Attorney, Agent, or Firm*—Parkhurst, Wendel & Rossi

[57] ABSTRACT

A disconnecting switch for a high voltage electrical substation, including a plurality of articulated arms pivotally connected together to define a movable system, one end of the movable system connected to a stationary support. The switch includes a contact head connected to an opposite end of the movable system, a main conducting bar suspended from a high voltage conductor, such that the contact head is movable between the main conducting bar and the stationary support via the movable system, and a stationary arcing contact electrically connected to the main conducting bar. The contact head includes an insulating fork defined by a v-shaped splayed part for contact with and centering of the main conducting bar, and a central slot which receives the main conducting bar, a movable main contact for electrical contact with the main conducting bar during engagement in the central slot, a movable arcing contact whip including a retaining pin and an operating mechanism for controlling the movable arcing contact whip to electrically contat the stationary arcing contact, including a trip lever and a finger, the finger movable between a locked position to lock the retaining pin and an unlocked position to unlock the retaining pin, the finger being driven by the trip lever which is biased from contact with the main conducting bar.

4 Claims, 7 Drawing Sheets

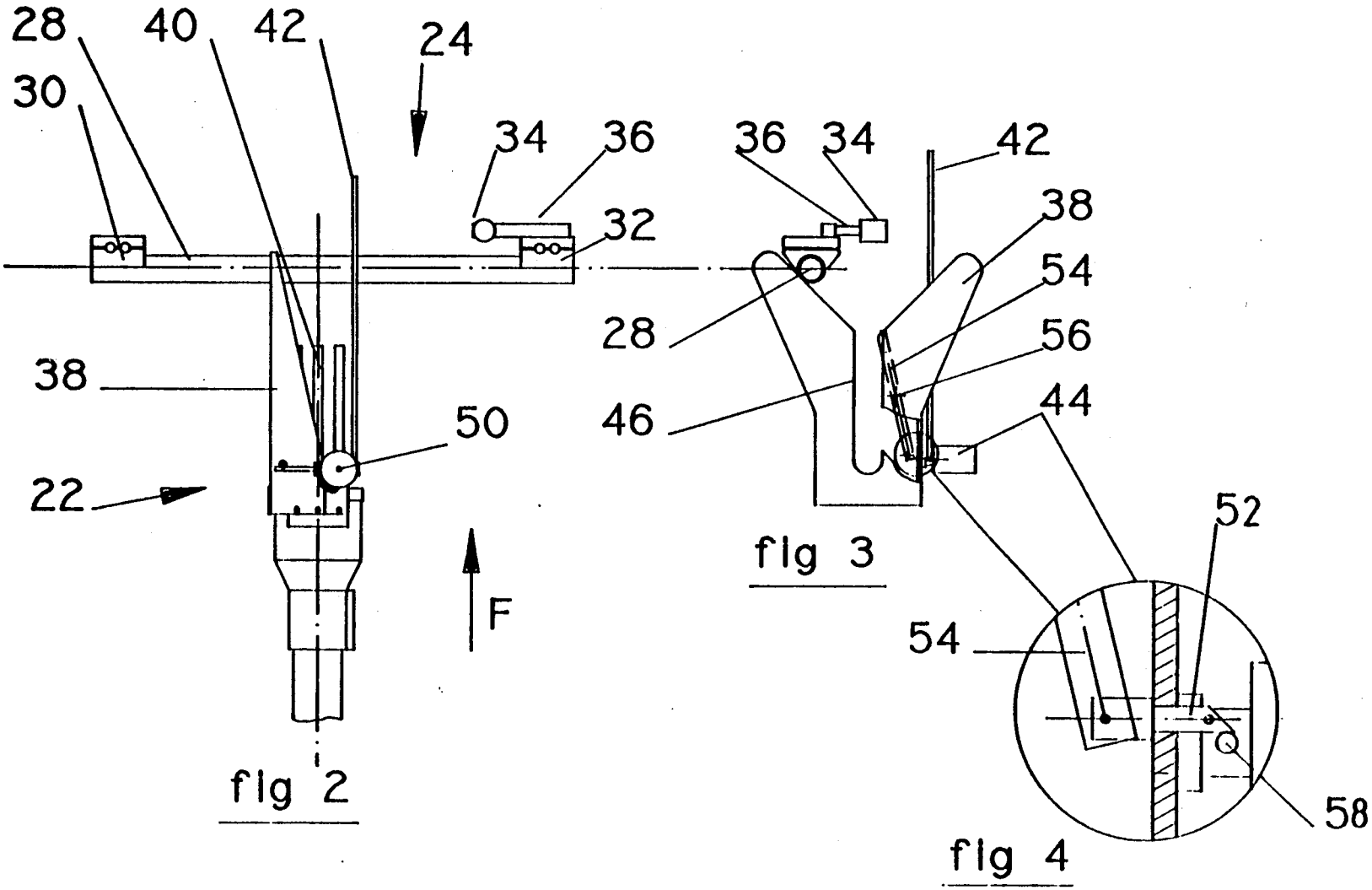
flg 2
flg 3
flg 4

HIGH VOLTAGE DISCONNECTING SWITCH

BACKGROUND OF THE INVENTION

The invention relates to a disconnecting switch for a high voltage electrical substation, particularly a pantograph or semipantograph disconnecting switch, comprising a movable system of articulated arms having a contact head cooperable with a main conducting bar of a pick-up device suspended from a high voltage conductor. The contact head includes a movable main contact and a whip-type movable arcing contact controlled by an operating mechanism arranged to ensure closing of the movable arcing contact before closing of the movable main contact, and insure opening of the movable arcing contact after opening of the movable main contact.

Disconnecting switches for high voltage substations have to open and close with strong loop currents. The presence of the whip enables the current to be branched off when the main contacts open and close, which notably prevents wear of the movable contact grips. The contact surface of the bar is however damaged by the electrical arc around the contact area thereof with the whip. Tripping of the whip operating mechanism is moreover achieved by means of a complicated kinematic linkage of the disconnecting switch requiring a specific tripping adjustment.

The object of the present invention is to improve the capacity and withstand of a whip-type disconnecting switch for high voltage substations.

SUMMARY OF THE INVENTION

The disconnecting switch according to the invention is characterized in that the operating mechanism comprises a locking finger designed to cooperate in the locked position with a retaining pin of the whip in a loaded state, and a trip lever controlled during the closing travel by the main bar after the latter has been centered by means of a guide device, bringing about movement of the finger to an unlocked position releasing the whip, which is then driven against a stationary arcing contact of the pick-up device.

Tripping of the whip takes place during the closing travel, and depends on the proximity of the pick-up bar, and not on the kinematics of the disconnecting switch.

Resetting of the whip and locking of the operating mechanism are performed at the end of opening travel by the action of a resetting lever.

The stationary arcing contact is formed by a brass auxiliary rod extending orthogonally to the main bar, whereas the whip is made of stainless steel. The choice of these materials prevents any contact welding, and transfers the wear to the auxiliary rod.

The guide device is equipped with an insulating fork securedly united to the contact head, and comprises a V-shaped splayed part for centering the main bar, and a central slot in which said bar engages to actuate the tripping lever to the unlocked state of the operating mechanism before the movable main contact closes.

BRIEF DESCRIPTION OF THE DRAWINGS

Other advantages and features will become more clearly apparent from the following description of an illustrative embodiment of the invention, given as a non-restrictive example only and represented in the accompanying drawings, in which :

FIGS. 2, 5, 7 and 9 show partial enlarged scale views of the contact head represented in FIG. 1, in the course of different stages of the closing travel;

FIGS. 3, 6, 8 and 10 are respective profile views of FIGS. 2, 5, 7 and 9;

FIG. 4 is a detailed view of FIG. 3;

DESCRIPTION OF THE PREFERRED EMBODIMENT

Figure 1:
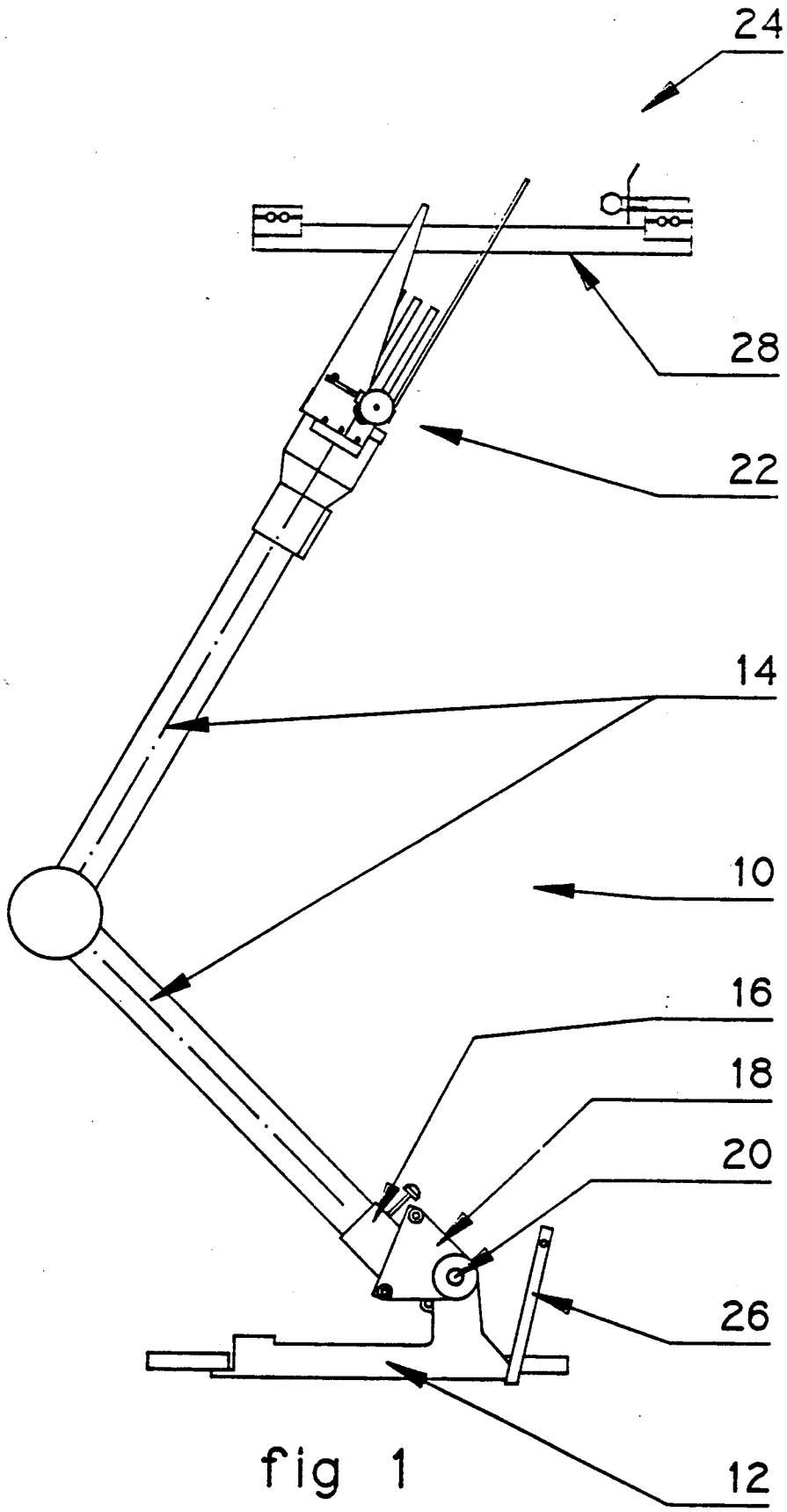
FIG. 1 is a schematic elevational view of a semi-pantograph disconnecting switch according to the invention.

In the Figures, a high voltage semi-pantograph disconnecting switch 10 is mounted on a porcelain insulator (not shown) by means of a support plate 12. The disconnecting switch 10 comprises a movable system of articulated arms 14 having at its base 16 a mechanical connection 18 pivotally mounted on a spindle 20 of the support plate 12, and at the opposite end, a contact head 22 cooperating with a pick-up device 24, which is generally suspended from a conducting cable of the high voltage system. The support plate 12 is equipped with a resetting lever 26 designed to automatically reset the disconnecting switch 10 when the contact head 22 moves to the open position.

Referring to FIGS. 2 to 12, the pick-up device 24 comprises a main conducting bar 28, supported by two opposite supports 30, 32, and a stationary arcing contact 34 constituted by a brass auxiliary rod. The main conducting bar 28, being horizontal, acts as the stationary main contact extending orthogonally to the stationary arcing contact rod 34, which is shorter than the bar 28, and located above the latter. A conductor 36 connects the stationary contact 34 to the support 32 so that it is at the same potential as the bar 28.

The contact head 22 is formed by a guide fork 38 made of insulating material, a grip-shaped movable main contact 40, and a whip-type movable arcing contact 42, controlled by an operating mechanism 44. The guide fork 38 comprises a straight central slot 46 whose width corresponds appreciably to the diameter of the main bar 28, and a V-shaped splayed part 48 for centering the bar 28 when closing takes place. The movable arcing contact whip 42 is formed by a stainless steel spring rod, mounted with limited rotation on a pivot 50 of the operating mechanism 44. The pivot 50 extends parallel to the stationary arcing contact rod 34, so that the movement of the movable whip takes place in a plane parallel to the bar 28.

The whip operating mechanism 44 is equipped with locking finger 52 (FIG. 4) designed to occupy a locked position and an unlocked position depending on the state of a trip lever 54 pivotally mounted on an intermediate spindle 56. The active end of the locking finger 52 cooperates in the locked position with a retaining pin 58, so as to ensure that the movable arcing contact 42 is maintained in a direction parallel to the guide fork 38. In this loaded position of the operating mechanism 44, the whip still remains separated from the bar 28 and from the stationary arcing contact rod 34.

Figure 7:
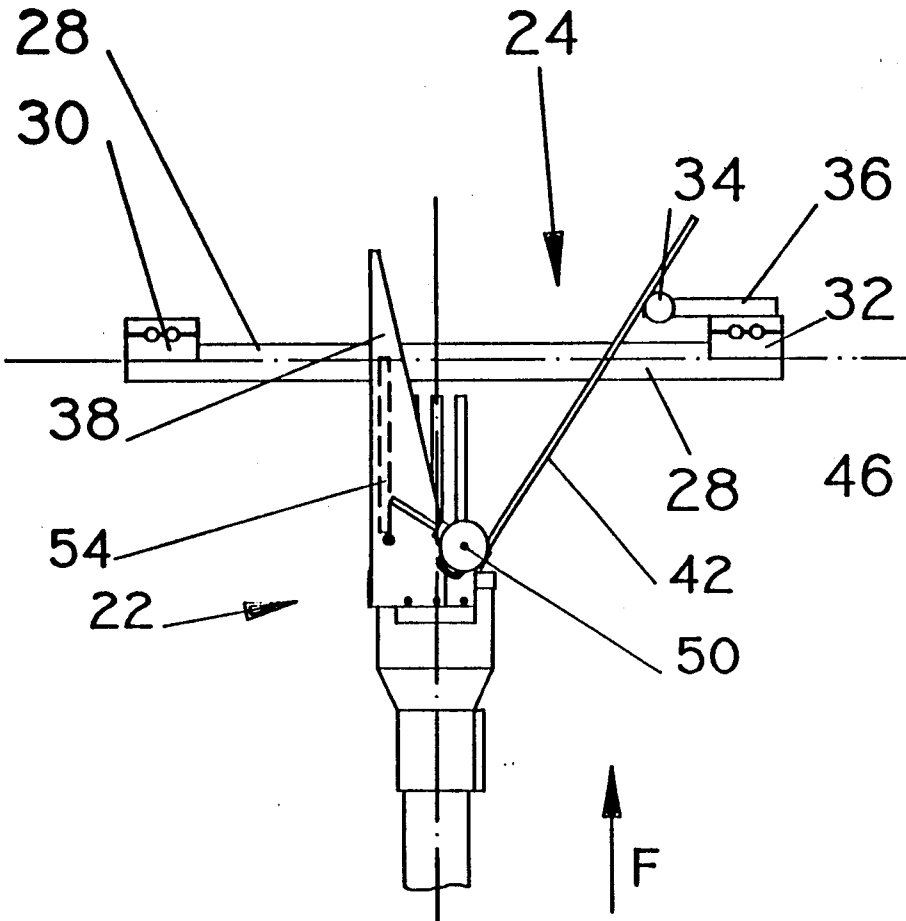
Figure 10:
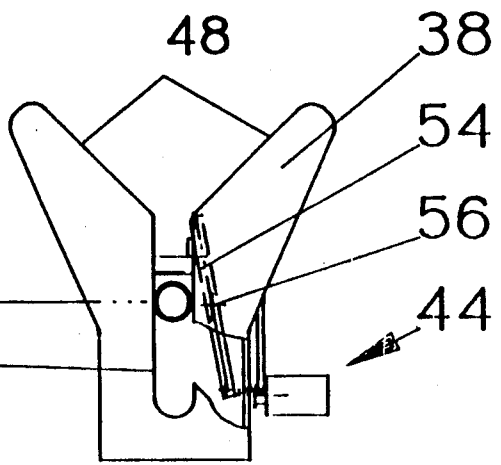
Figure 9:
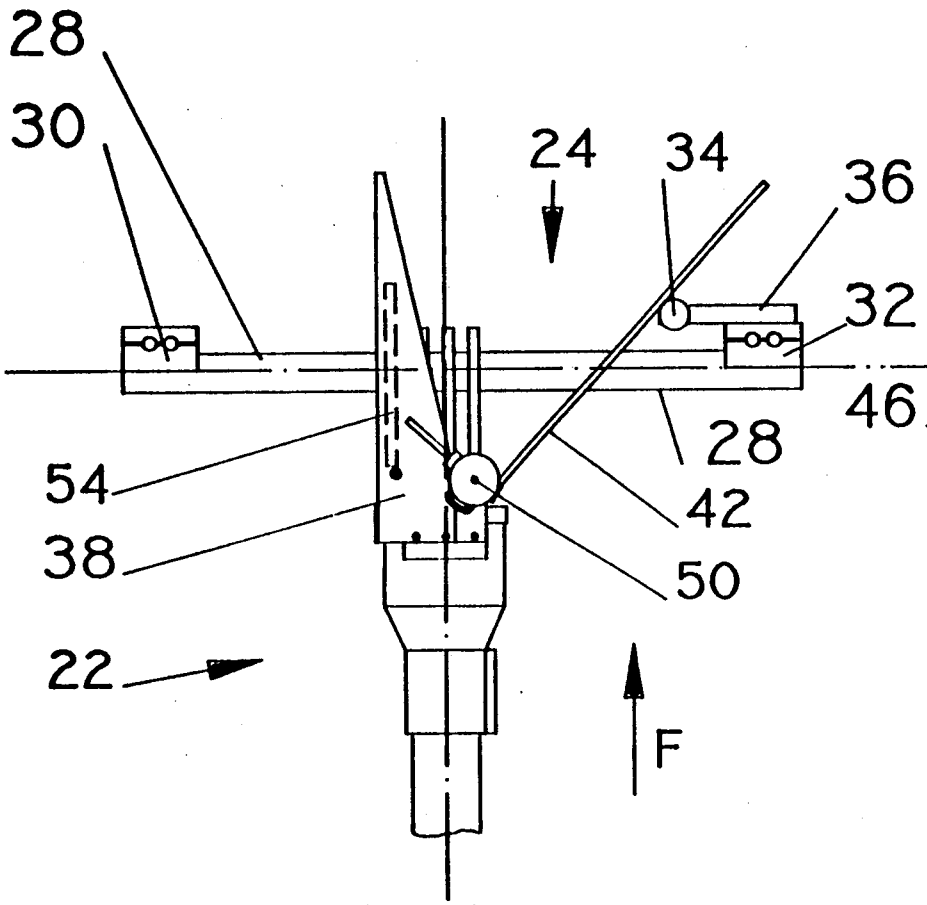
Figure 11:
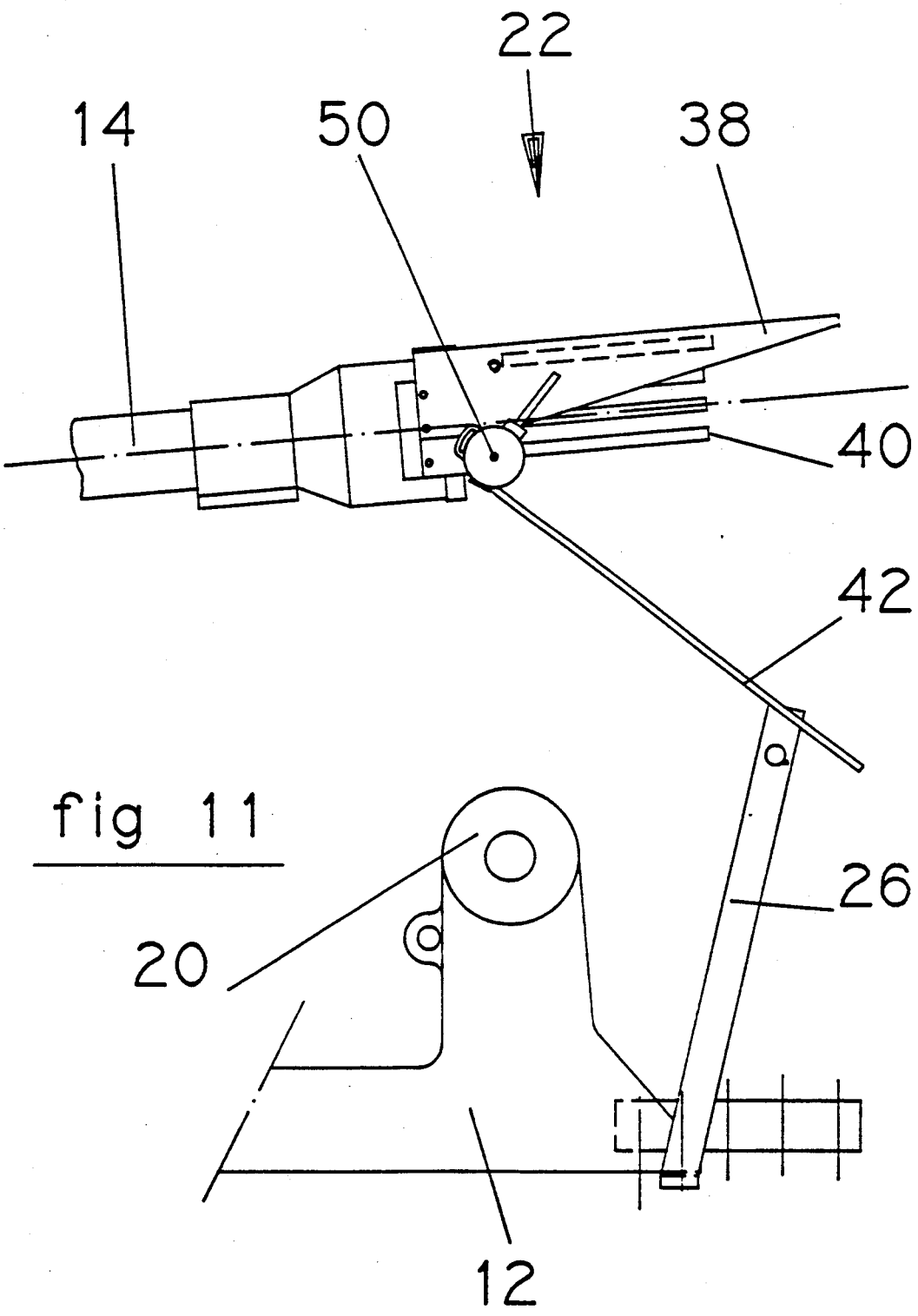
FIGS. 11 and 12 represent views of the contact head, respectively close to and at the end of closing travel of the disconnecting switch.

Movement of the finger 52 from the locked position to the unlocked position takes place during the closing phase of the disconnecting switch 10, when the trip lever 54 is biased by the bar 28 (FIG. 4). The beginning of actuation of the trip lever 54 takes place at the end of the recentering phase of the bar 28 when it engages in the central slot 46 of the guide fork 38. The trip lever 54 is then driven in clockwise rotation around the spindle 56, so as to release the pin 58 into an unlocked position. This results in tripping of the whip which pivots about the pivot 50, biased by a torsion spring mounted on the pivot 50. The pivoting movement of the whip stops when it comes up against the stationary arcing contact rod 34 (FIG. 7).

Operation of the disconnecting switch 10 is as follows :

CLOSING

In the open position of the disconnecting switch 10 (FIG. 12), the movable arcing contact whip 42 is loaded by the resetting lever 26, and is held in this position by the finger 52 in the locked position. The contact head 22 is in a low zone, near the support plate 12. When a closing order is emitted, the mechanical connection 18 rotates clockwise around the spindle 20, driving the contact head 22 towards the pick-up device (FIG. 1).

The V-shaped part 48 of the insulating guide fork 38 then bears against the main bar 28 (FIGS. 2 and 3), allowing a progressive centering effect of the main bar 28 when upward movement of the contact head 22 takes place, as indicated by the arrow F.

Figure 6:
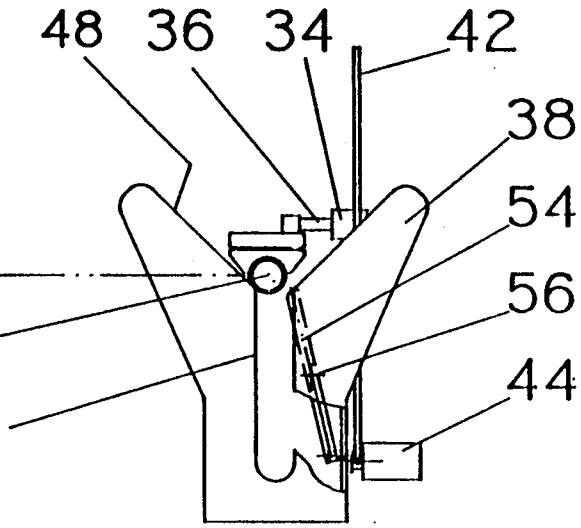
Figure 5:
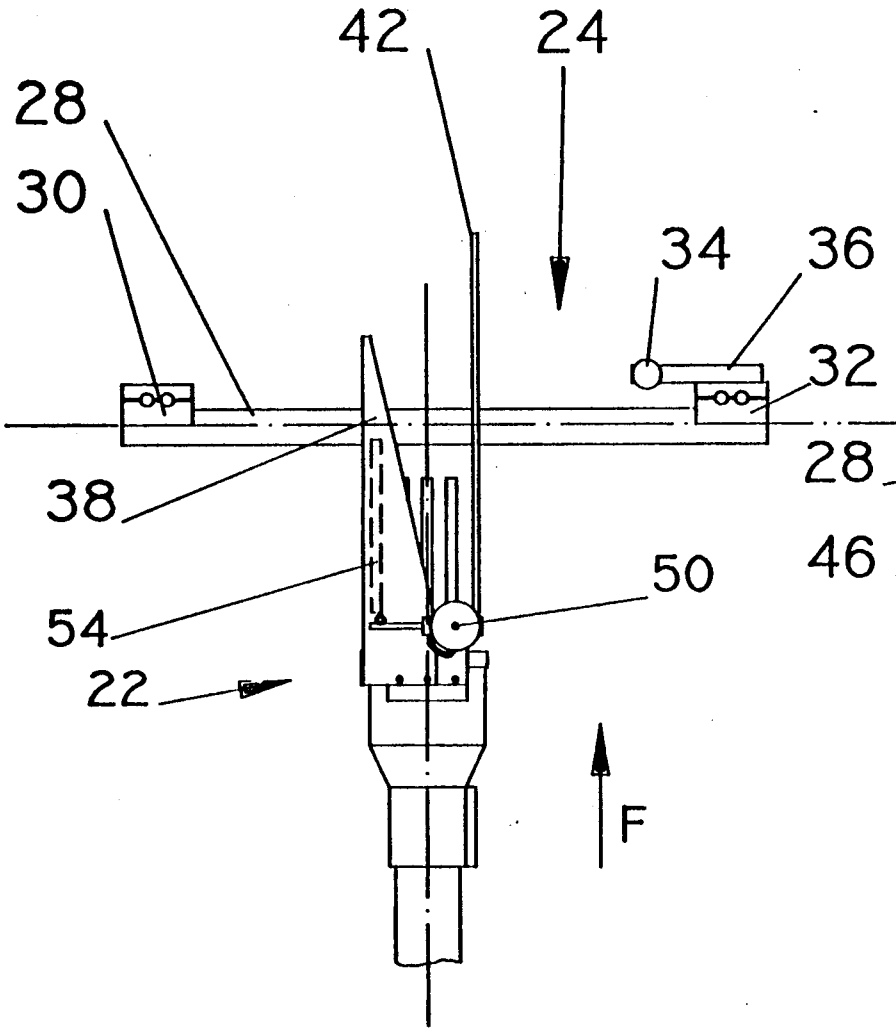
Figure 8:
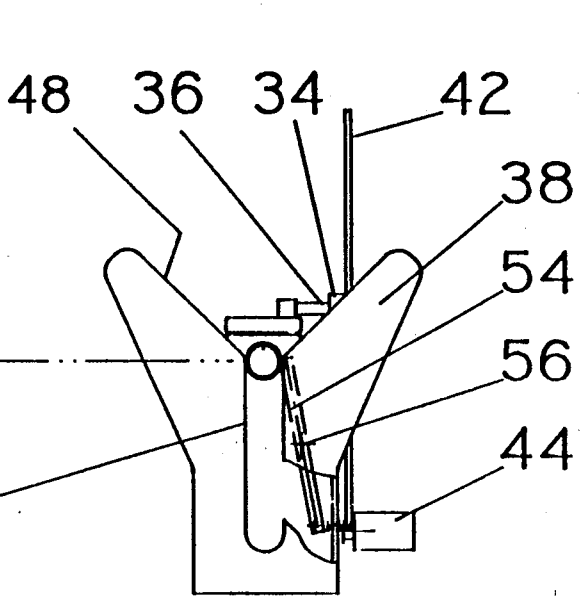

In FIGS. 5 and 6, the recentering operation of the bar 28 by the guide fork 38 is completed. The main bar 28 is at the entry to the slot 46, and is kept out of contact with the movable main contact grips 40. In this position, the trip lever 54 is separated from the main bar 28 by a small gap.

In the course of the continued upward movement of the contact head 22 (FIGS. 7 and 8), the main bar 28 engages in the straight slot 46 of the guide fork 38, and actuates the trip lever 54, which pivots around the spindle 56. Retraction of the finger 52 to the unlocked position then releases the operating mechanism 44 of the whip 42, which strikes the stationary arcing contact rod 34, establishing the current in the arcing circuit. In this position, the movable main contact grips 40 are still out of contact with the bar 28.

At the end of the closing travel of the contact head 22 (FIGS. 9 and 10), the disconnecting switch 10 terminates its movement by closing of the movable main contact grips 40 on the bar 28. This closing takes place without an arc between the bar 28 and contact grips 40.

OPENING

In the closed position of the disconnecting switch 10 (FIGS. 9 and 10), the operating mechanism 44 is in the tripped state and the bearing force of the whip on the stationary arcing contact 34 is greater than 2daN. After the opening order has been emitted, the mechanical connection 18 rotates counterclockwise around the spindle 20 causing the contact head 22 to descend. The latter moves away from the main bar 28, and the movable main contact grips 40 separate. The current then flows via the whip and arcing contact rod 42, 34. In the course of continued downward movement, the whip slides on the stationary arcing contact rod 34, and finally breaks free with interruption of the current. At this moment, the whip is still in the tripped position.

Figure 12:
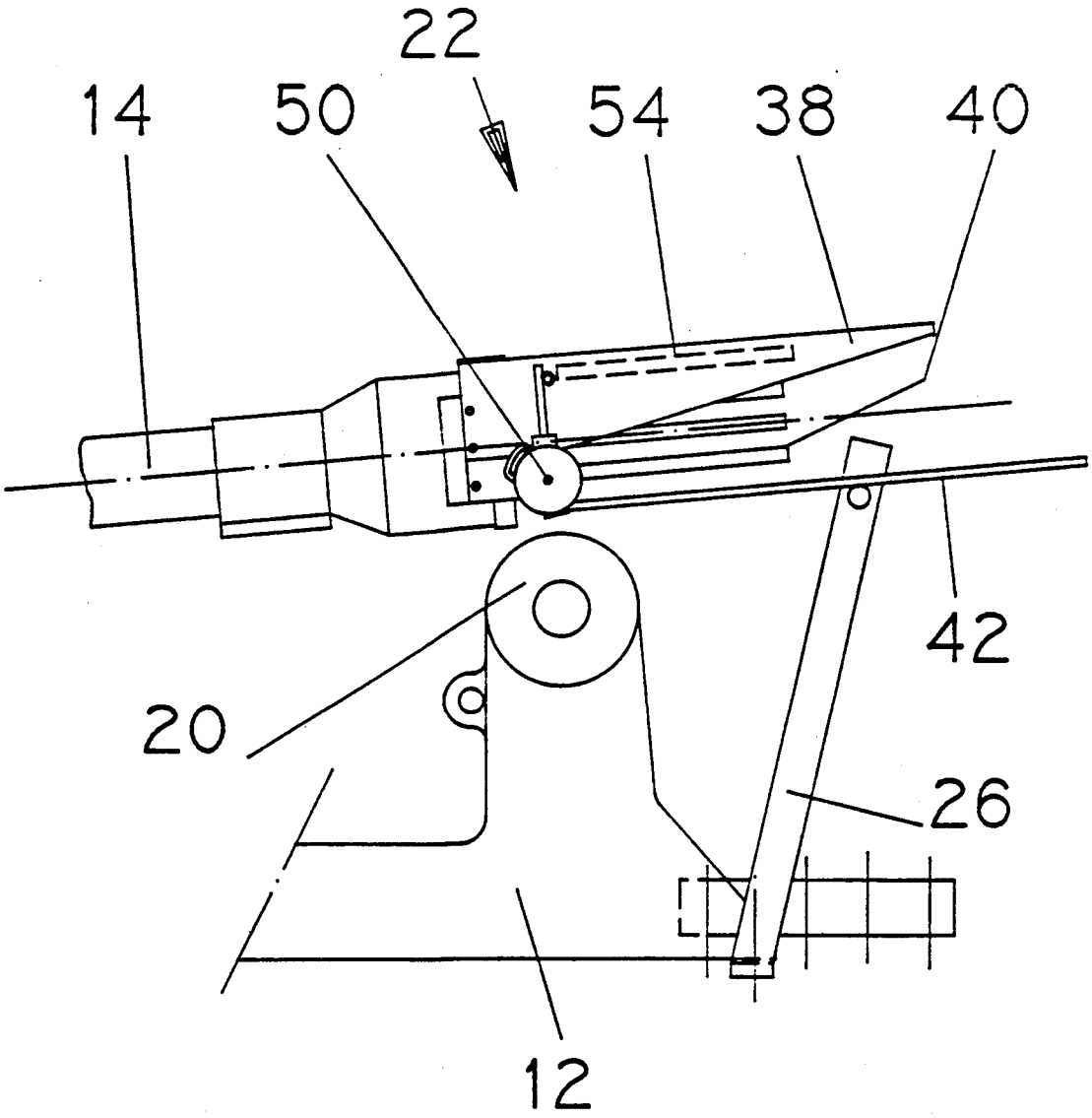

Close to the open position of the disconnecting switch 10 (FIG. 11), the whip comes up against the resetting lever 26. The spring of the whip is tautened until the retaining pin 58 is locked by the finger 52. The disconnecting switch 10 is then in the fully open position with automatic resetting of the whip operating mechanism 44 (FIG. 12).

It can be noted that tripping of the whip operating mechanism 44 depends essentially on the action of the main pick-up bar 28 on the trip lever 54. This tripping only takes place on closing of the disconnecting switch when the bar 28 is suitably centered by the guide fork 38. Resetting of the operating mechanism 44 is automatic at the end of opening travel of the disconnecting switch 10.

The presence of the whip associated with its operating mechanism 44 enables disconnecting switches with current intensities of up to 3000A in low voltage to be opened and closed. The choice of the contact materials, i.e. the stainless steel whip, and the brass stationary arcing contact rod 34, prevents any welding effect of the contacts when a high arcing current occurs. The arc is extinguished in the air, and wear is accommodated by the brass stationary arcing contact rod 34. The main bar 28 is not subjected to any wear, given that no arc occurs between movable main contact grips 40 and main bar 28.

The assembly comprising the whip and operating mechanism 44 can easily be adapted to already installed disconnecting switches without modification of the main contacts.

The invention is applicable to any other type of disconnecting switch, notably of the pantograph or blade type.

We claim:

1. A disconnecting switch for a high voltage electrical substation, comprising:

a plurality of articulated arms pivotally connected together to define a movable system, one end of said movable system being connected to a stationary support means;

a contact head connected to an opposite end of said movable system;

a main conducting bar suspended from a high voltage conductor, such that said contact head is movable between said main conducting bar and said stationary support means via said movable system; and a stationary arcing contact electrically connected to said main conducting bar, said contact head comprising:

an insulating fork defined by a v-shaped splayed part for contact with and centering of said main conducting bar, and a central slot which receives said main conducting bar;

a movable main contact for electrical contact with said main conducting bar during engagement of said main conducting bar in said central slot;

a movable arcing contact whip including a retaining pin; and an operating mechanism for controlling said movable arcing contact whip to electrically contact said stationary arcing contact, comprising a trip lever and a finger, said finger movable between a locked position to lock said retaining pin to prevent movement of said movable arcing contact whip and an unlocked position to unlock said retaining pin to allow movement of said movable arcing contact whip, said finger being driven by said trip lever which is biased from contact with said main conducting bar.

2. The disconnecting switch of claim 1, wherein said stationary support means comprises a support plate, said support plate including a resetting lever cooperable with said movable arcing contact whip to reset said contact whip during opening of said disconnecting switch.

3. The disconnecting switch of claim 1, wherein said stationary arcing contact comprises an auxiliary conducting rod perpendicularly extending with respect to said main conducting bar, said movable arcing contact whip being pivotally mounted such that said movable arcing contact whip pivots in a plane substantially parallel to said main conducting bar.

4. The disconnecting switch of claim 1, wherein said trip lever is pivotally mounted on an intermediate pin, said trip lever including a first end connected to said finger and a second end positioned for abutting contact with said main conducting bar during centering thereof within said v-shaped splayed part.

* * * * *